US007721892B2

(12) United States Patent
Hortel

(10) Patent No.: US 7,721,892 B2
(45) Date of Patent: May 25, 2010

(54) ADAPTABLE TOTE FOR BEVERAGE CUPS AND PLATES

(75) Inventor: Thomas Charles Hortel, Cincinnati, OH (US)

(73) Assignee: Zenovate Ltd., Loveland, OH (US)

( * ) Notice: Subject to any disclaimer, the term of this patent is extended or adjusted under 35 U.S.C. 154(b) by 825 days.

(21) Appl. No.: 11/330,000

(22) Filed: Jan. 11, 2006

(65) Prior Publication Data

US 2006/0157376 A1 Jul. 20, 2006

Related U.S. Application Data

(60) Provisional application No. 60/644,221, filed on Jan. 14, 2005.

(51) Int. Cl.
*A45C 11/20* (2006.01)

(52) U.S. Cl. ..... 206/549; 206/159; 206/216; 206/161; 294/87.2; 294/87.28; 294/27.1; 294/159; 294/160

(58) Field of Classification Search ..... 206/139–203, 206/549, 217; 229/932–937; 294/27.1, 159–160, 294/172, 87.2–87.28, 158
See application file for complete search history.

(56) References Cited

U.S. PATENT DOCUMENTS 1,005,235 A * 10/1911 Langguth ..... 294/87.2
1,112,300 A * 9/1914 Ligeour ..... 206/145
2,029,535 A * 2/1936 Langel ..... 294/160
2,153,391 A * 4/1939 Projansky ..... 294/27.1
2,559,739 A * 7/1951 Sherman ..... 211/70
2,923,406 A * 2/1960 Poupitch ..... 294/87.2
3,097,740 A * 7/1963 Poupitch ..... 206/143
3,693,830 A * 9/1972 Oglesbee ..... 206/162
3,751,098 A * 8/1973 Owen ..... 294/87.2
3,888,348 A * 6/1975 Frey ..... 206/427
4,033,489 A * 7/1977 Fowler ..... 294/159
4,168,025 A * 9/1979 Bantner ..... 294/159
4,537,310 A * 8/1985 Thul ..... 206/526
5,060,999 A * 10/1991 Marvin ..... 294/87.2
5,168,990 A * 12/1992 Johnson ..... 206/151
5,217,271 A * 6/1993 Moe ..... 294/1.1
5,620,707 A * 4/1997 Sanker et al. ..... 424/489
D404,919 S * 2/1999 McCorkle, Jr. ..... D3/315

* cited by examiner

*Primary Examiner*—Ehud Gartenberg
*Assistant Examiner*—Andrew Perreault
(74) *Attorney, Agent, or Firm*—Lafkas Patent LLC; David M. Lafkas; Matthew E. Vale

(57) ABSTRACT

The invention is a beverage cup tote to be carried on the forearm or with the hand. The construct has an enlarged first end attached with bridge section to an enlarged second end. There is a first hole in the first enlarged end, and a second hole in a second enlarged end. The holes may be rectangular or round to receive typical food containers or beverage cups. The bridge section has either symmetrical or asymmetrical quarter circle trimmings. A pair of constructs maybe affixed with each other with a pin clip, glue, or staples to produce a generally X shaped combination construct. The beverage cup totes may be manufactured as a combination construct by the manufacturer to produce a strengthened unit, or manufactured as a generally X shaped combination construct unit with cup openings on each branch. The process of using the invention is described.

8 Claims, 16 Drawing Sheets

ADAPTABLE TOTE FOR BEVERAGE CUPS AND PLATES

Priority claimed to Provisional application 60/644,221 filed Jan. 14, 2005

FIELD OF INVENTION

The invention is concerned with devices that allow the carrying of two or more beverage cups or food containers in a convenient manner. At sporting events, commonly one person will buy drinks and food for a small group. The present invention is a simple arm carrier for beverages for use at sporting events and such.

BACKGROUND OF INVENTION

Often friends and associates attend sporting events or picnics in small groups. At such events, ordinarily one person will obtain drinks and food from the concession stand for one or two people in addition to his own food and drinks. Thus a person obtaining the drinks and food will be required to carry multiple drinks and possibly one or more plates of food. This can be quite inconvenient. The spilling and wasting of the newly purchased food is common. While many food items can be packed in paper bags it is relatively difficult to safely transport soft drinks even with covers on the cups. For these reasons, there is a relatively large art, for example D 426,431; U.S. Pat. Nos. 4,979,657; 5,704,671; and 5,743,389; addressing the problems of transporting soft drinks and coffee at sporting venues and such.

The present invention is an adaptable arm tote or carrier which is inexpensive to manufacture and simple to use.

SUMMARY OF INVENTION

The invention is a beverage cup tote which is a construct with an enlarged first end attached with bridge section to an enlarged second end. There is a first hole in the first enlarged end, and a second hole in a second enlarged end. The bridge section length is about 3.5 inches to 6.5 inches. The first hole and second hole are rectangular or round to receive typical food containers or beverage cups. The bridge section length is about 3.5 inches to 6.5 inches. The width between the holes and the outer perimeter is about three quarters inch to one and one-half inches. A thumb hole may be incorporated into the bridge section.

The bridge section has a clip passage and either symmetrical or asymmetrical quarter circle trimmings. A pair of constructs may be affixed with each other with a pin clip through a clip passage, or with glue, staples, adhesives, or cohesive to produce a generally X shaped combination construct. That pin clip has one or more curved wings(s) which will hold workpiece plate(s). The glue, adhesives, or cohesive maybe covered with release paper. However, a pair of beverage cup totes may be manufactured as a combination construct by the manufacturer to produce a strengthened unit, or manufactured as a generally X shaped combination construct unit with cup openings on each branch of said X-shaped construct.

Likewise, the invention is a process for carrying beverages and food with adaptable totes with the steps of acquiring the beverages or food and assembling the appropriate form of tote(s) according to the types and sizes of the food containers. The purchased beverages or food are placed in the adaptable tote. That tote for beverages or food is a semi-rigid construct with a an enlarged first end with a first hole, and an enlarged second end with a second hole. The two ends are connected with a bridge section. That bridge section may either symmetrical or asymmetrical quarter-circle trimmings.

The first hole and second hole are sized such to receive typical beverage cups or rectangular food containers. The process continues whereby the food or beverages are placed into or upon either or both said first hole and said second hole, The tote with drinks is placed upon the forearm or in the hand and transported to place of consumption.

DETAILED DESCRIPTION OF THE FIGURES

Figure 1:
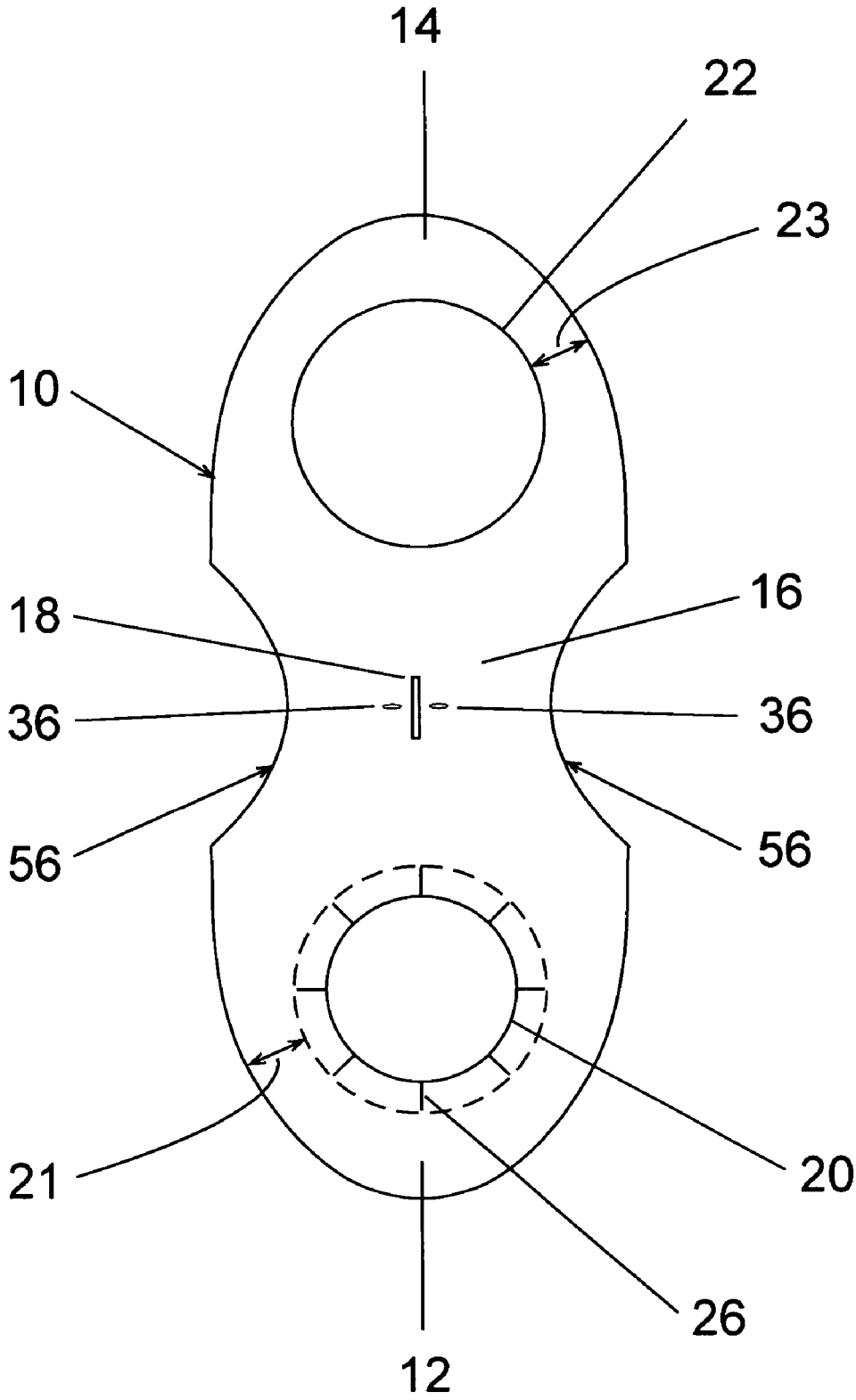
FIG. 1 shows a top view of the semi-rigid beverage cup (drink) tote.

FIG. 1 shows a top view of the semi-rigid beverage cup (drink) tote 10. Drink tote 10 is a flat construct with an enlarged first end 12 and an enlarged second end 14. Enlarged first end 12 is attached to enlarged second end 14 with bridge section 16. An optional clip passage 18 pierces at mid point of bridge section 16. First hole 20 is in the first enlarged end 12. A second hole 22 is in second enlarged end 14. The first hole 20 and the second hole 22 are sized such to receive typical beverage cups. Optionally a means is provided to hold more securely the workpiece beverage cups within the holes. Radial cuts 26 around the circumference of hole 20 will bend down as the workpiece cups are urged into it. Of course, there are means other than radial cuts to secure a cup in carrier holes. Bridge section 16 may have quarter circle trimmings 56. The semi-rigid construct width 21 between first hole 20 is in first enlarged end 12 and its outer edge is between about three quarters inch and one and one/half inches Semi-rigid construct width 23 between second hole 22 in said second enlarged end 14 and its outer edge is between about three quarters inch and one and one/half inches. The bridge length 29 measured between first hole 20 and second hole 22 is between about 3.5 inches and 6.5 inches. The drink tote 10 could be made of any of several semi flexible flat materials easily cut in a cutting press, such as compressed chipboard, corrugated paper, or plastic.

Figure 2:
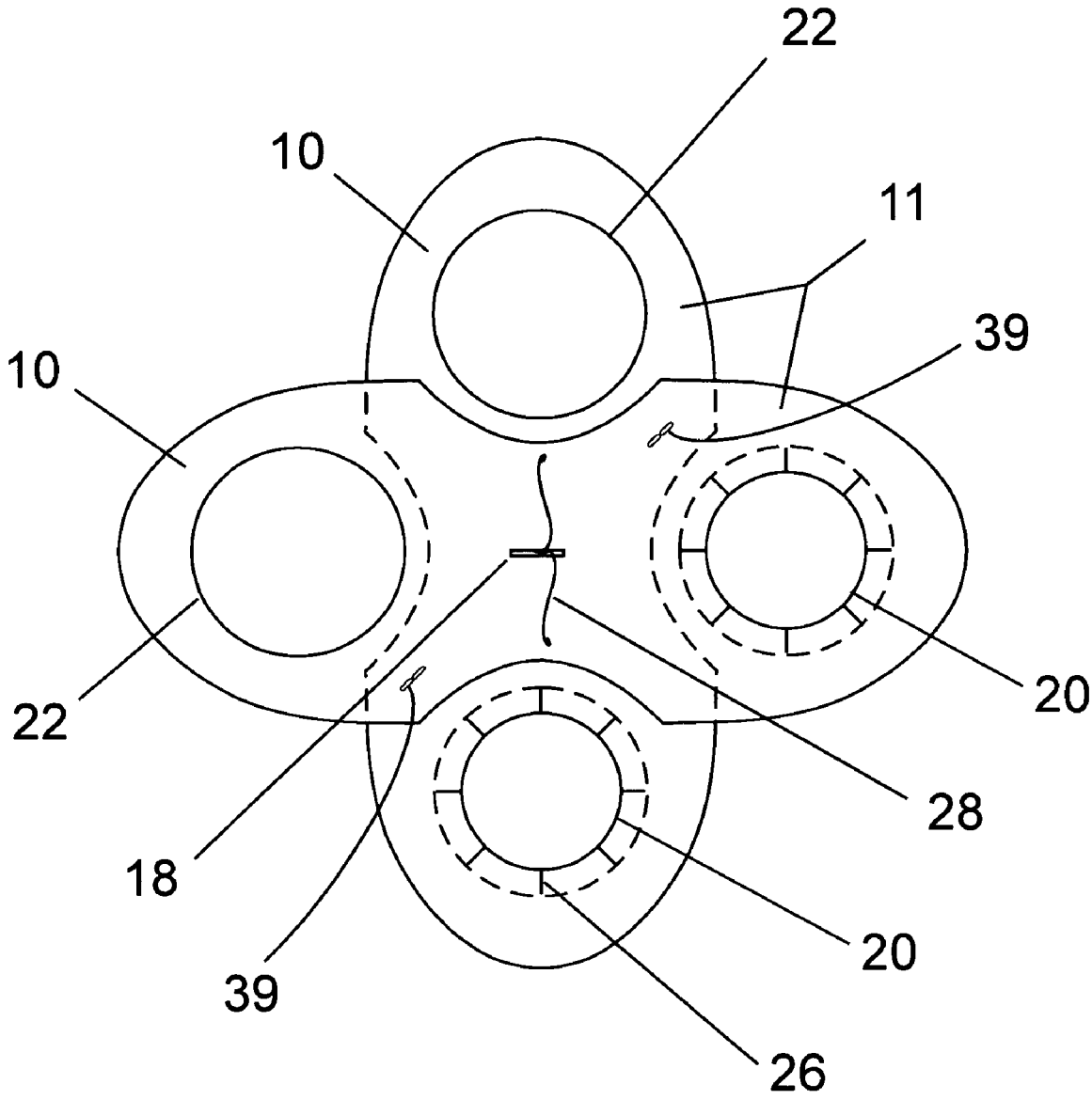
FIG. 2 shows that a pair of drink totes can be used in combination to carry the drink cups.

FIG. 2 shows that a pair of drink totes 10 can be used in combination to carry the drink cups. An attachment means, such as pin clip 28 is pushed through the clip passage 18 to connect a pair of drink totes 10. Pin clip 28 affixes the pair of drink tokes 10 in a generally X shaped combination construct 11. First holes 22 are shown. Second holes 20 are shown with radial cuts 26. Pin clip 28 will not only affix the pair of drink totes 10 together but also will attach a plastic or paper plate or other container to the pair of totes 11. An alternative means such as staples 39 or glue may be used to manufacture two totes 10 as a unit to strengthen the construct by having the two bridges cross Quarter circle trimmings 56 allows the transported cups to be placed with interference from the bridge 16.

Figure 3:
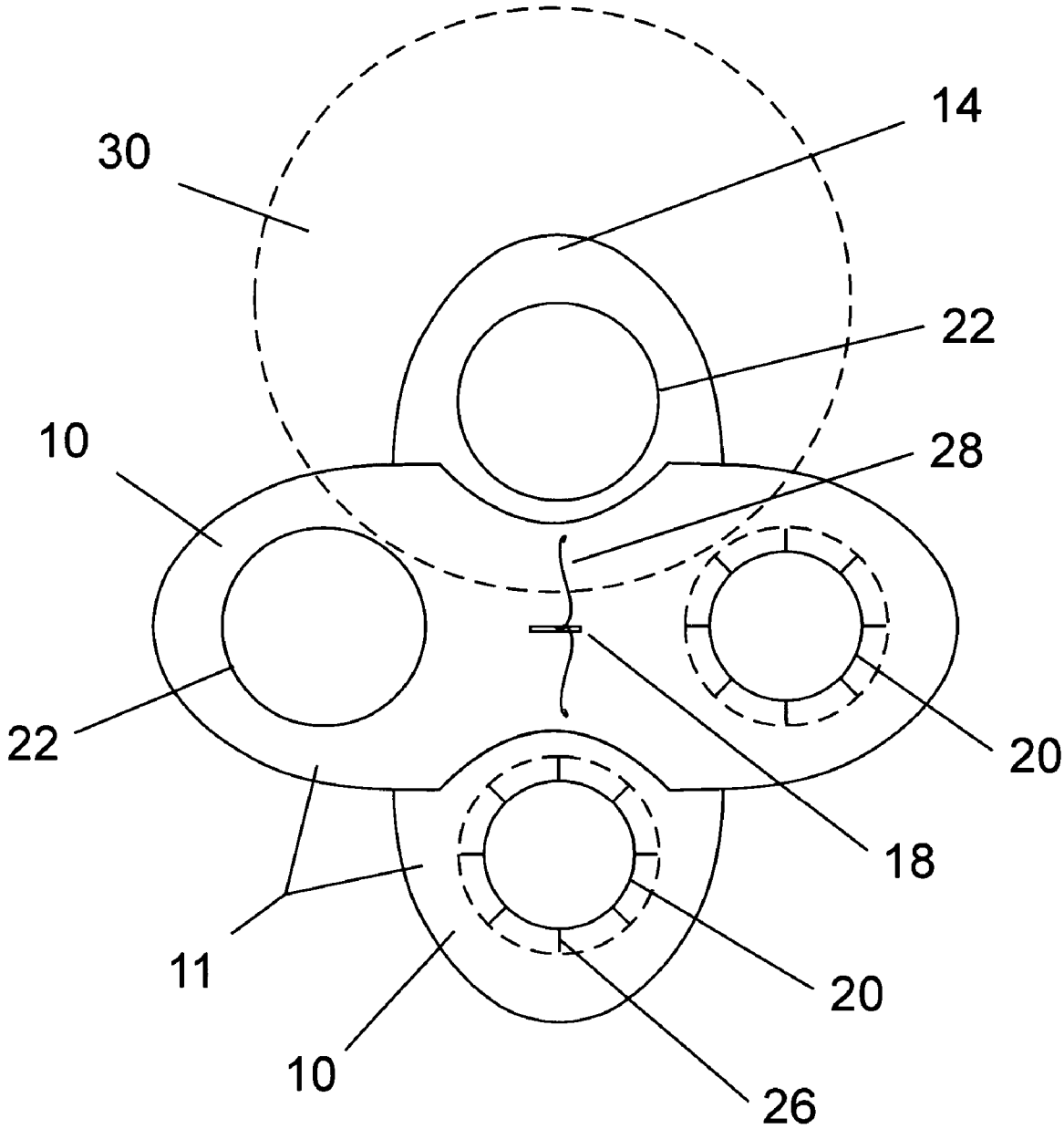
FIG. 3 shows a pin clip in operation.

FIG. 3 shows that be pin clip 28 will not only affix the pair of drink totes 10 together but also will attach a plastic or paper plate 30 (shown in outline) to the pair of totes shown as generally X shaped combination 11.

Figure 4:
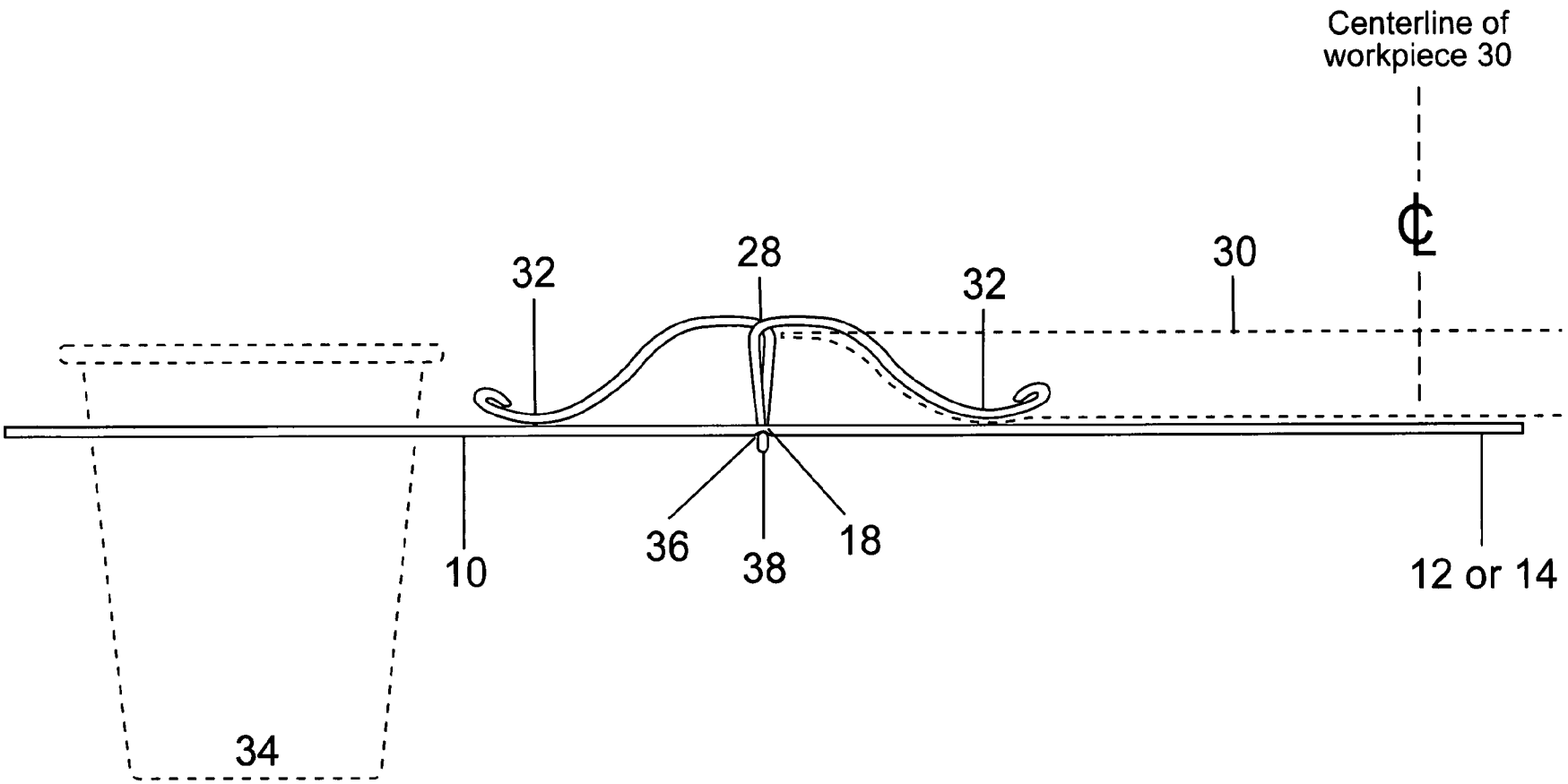
FIG. 4 shows a cross section view of a single drink tote with a side view of pin clip.

FIG. 4 shows a cross section view of a single drink tote 10 with a side view of pin clip 28. An outline of workpiece cup 34 is shown placed holes 20 or 22. Clip 28 with has wings 32 and clip key 38. Clip wings 32 holds a workpiece plate 30 (shown in section) on the tote 10.

Figure 5:
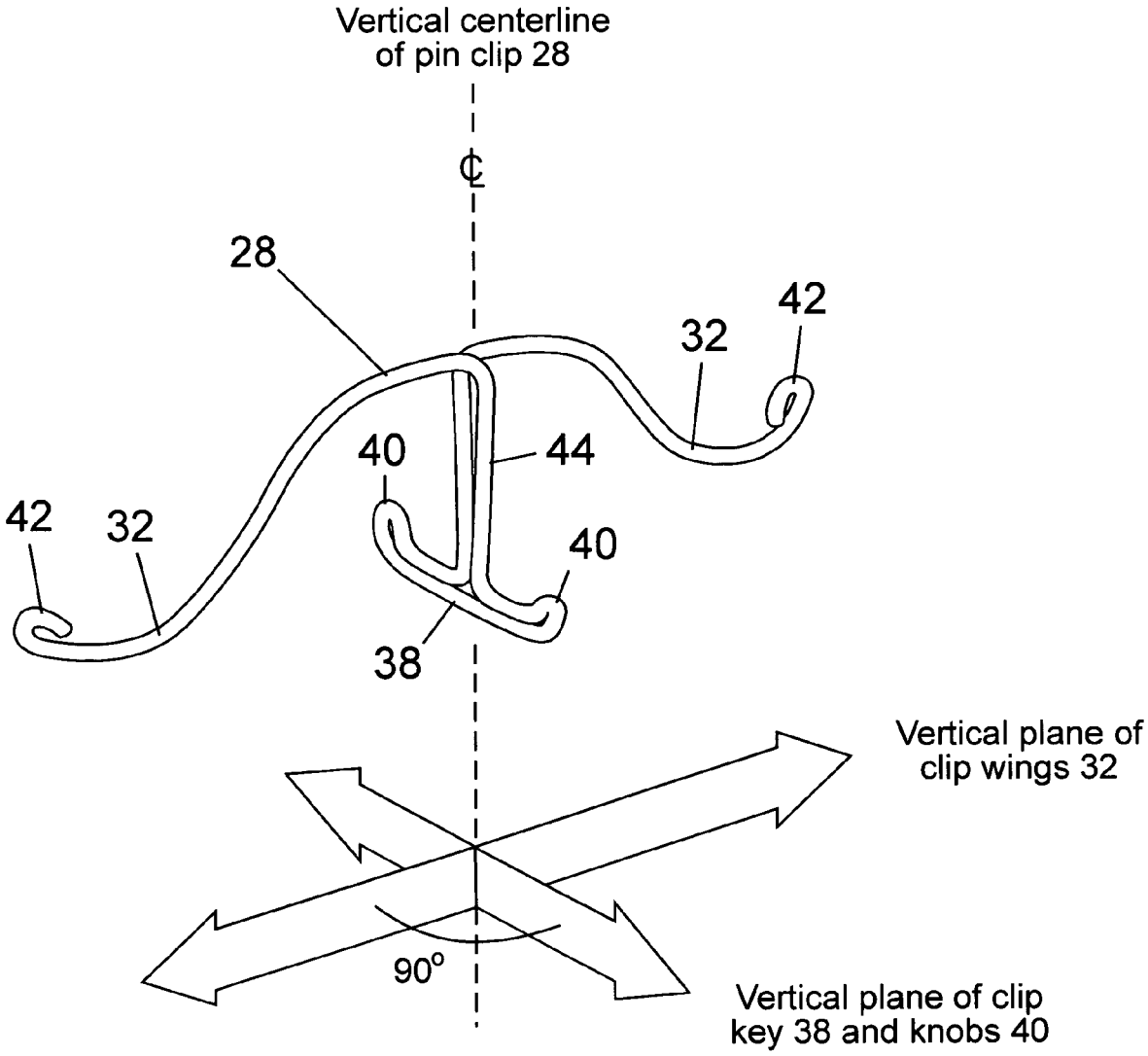
FIG. 5 shows clip with wings with bent ends.

FIG. 5 shows clip 28 with wings 32 and with bent ends 42. Clip key 38 has clip knobs 40. Wings 32 are connected by axial section 44 to clip key 38. Wings 32 and clip key 38 are at right angles in this particular embodiment but could be at any number of other angles.

Figure 6:
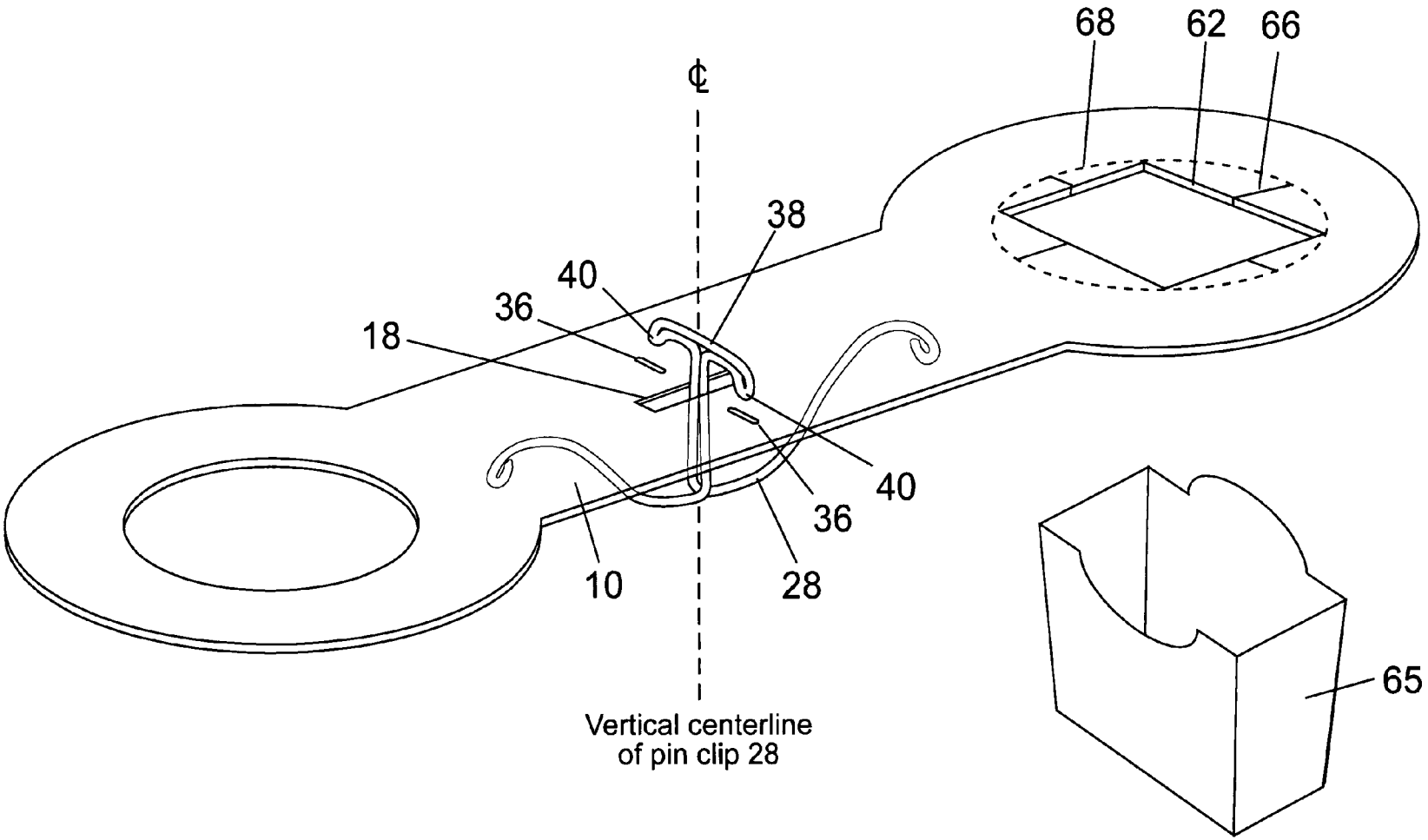
FIG. 6 show the underside of tote which is shown in this figure as a dumbbell shaped construct.

FIG. 6 shows the underside of tote 10 which is shown in this figure as a dumbbell shaped construct. Clip knobs 40 will rest in indentations 36. In this figure, clip passage 18 is at a right angle to clip key 38. Clip key 38 affixes clip 28 to tote 10. FIG. 6 illustrates that holes such as 62 may be rectangular to receive workpiece 65 which is a typical container configuration for cooked French fries. This rectangular form of hole 62 may be modified by radial cuts 66 on hole 68. Such radial cuts allow the placement of round cups 34.

Figure 7:
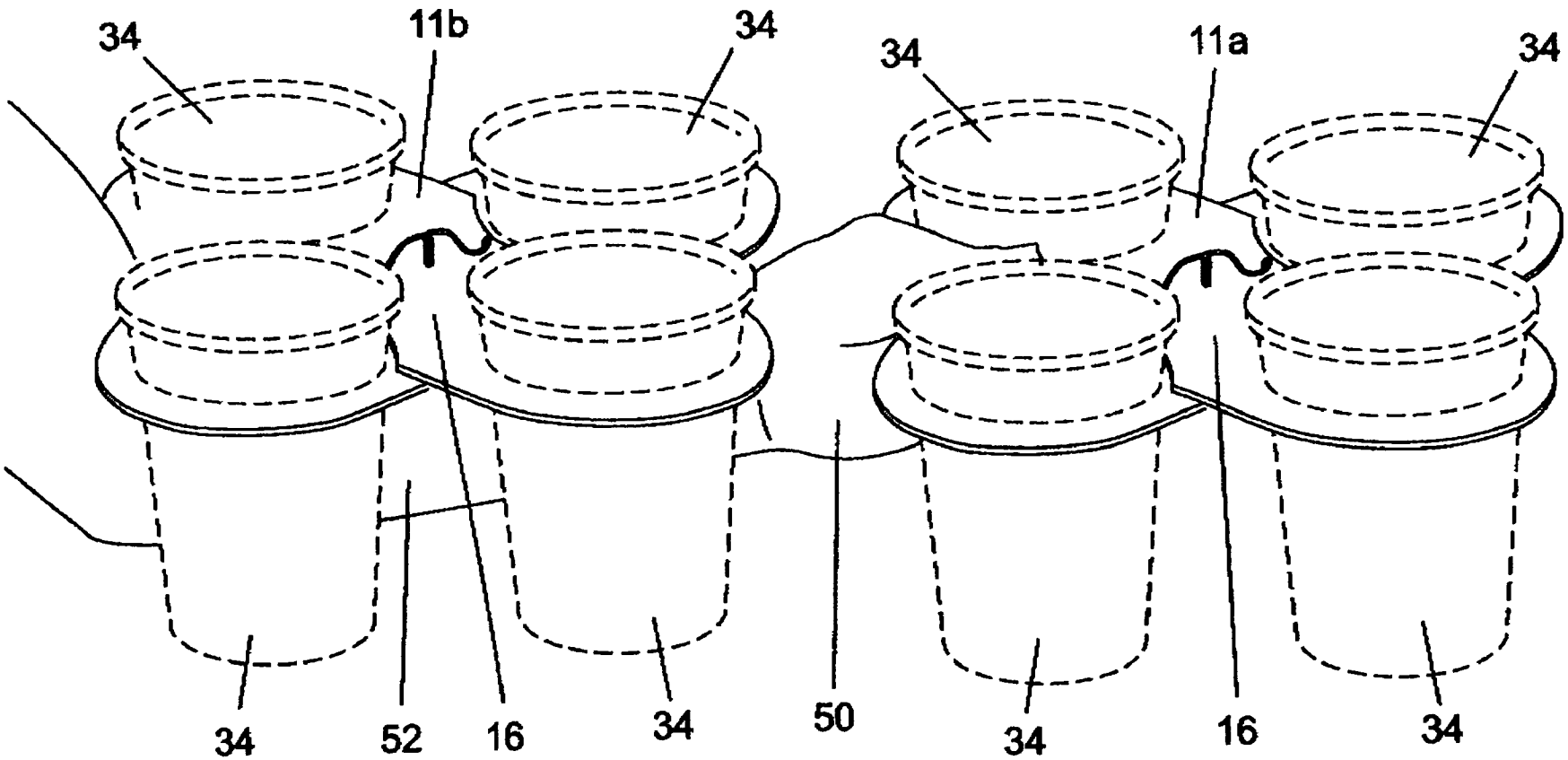
FIG. 7 shows that two pairs of totes can be used to carry up to 8 cups.

FIG. 7 shows that two pairs of totes 10, shown as 11*a* and 11*b*, can be used to carry up to 8 drinks in cups 34. Generally X shaped combination 11*a* will carry 4 drinks in one customer hand 50 while generally X shaped combination 11*b* may be carried on the customer forearm 52. Note, quarter circle trimmings 56 allow for the ease of placement of cups 34 in generally X shaped combination 11.

Figure 8:
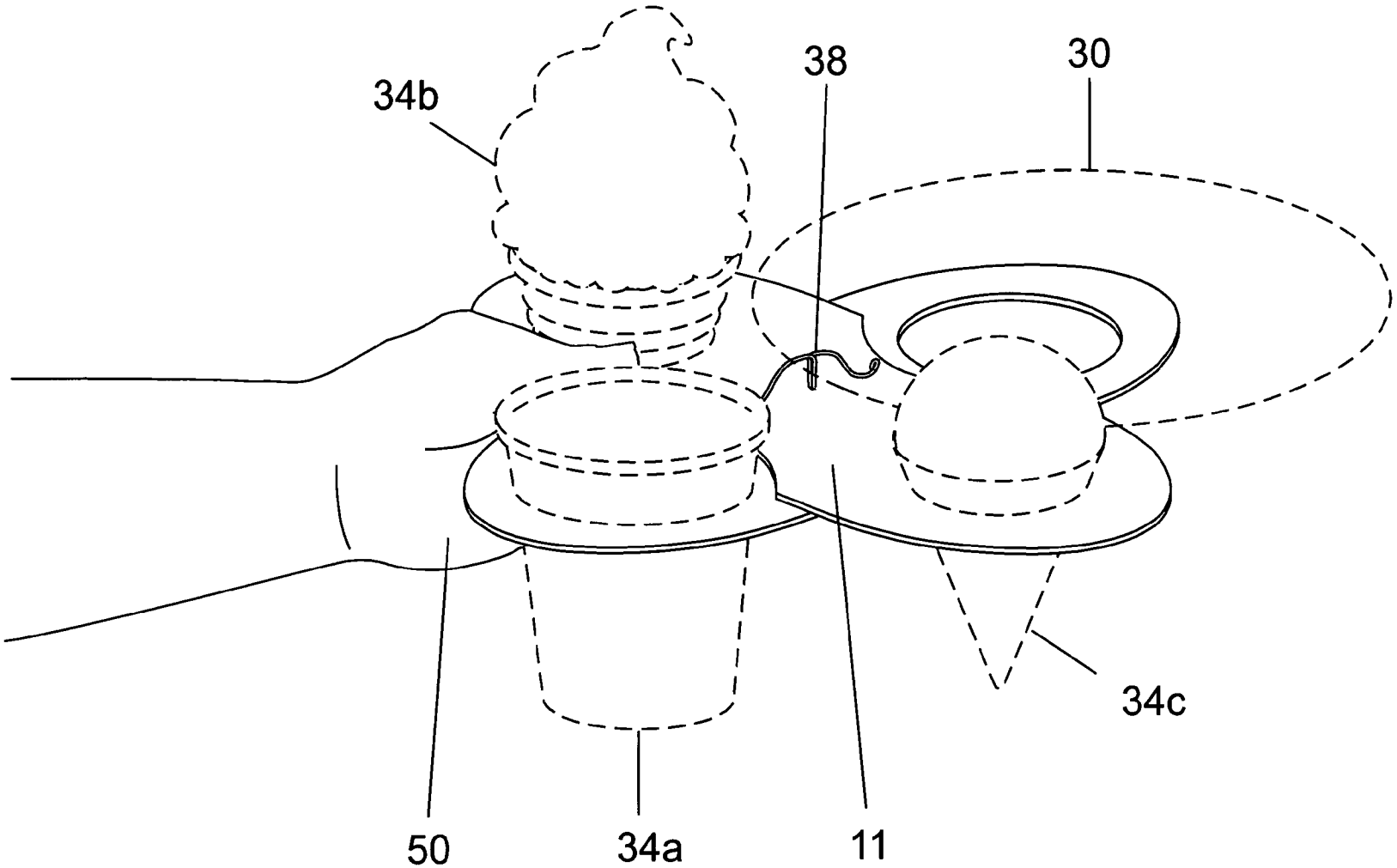
FIG. 8 demonstrates that the inventive tote has the flexibility to carry items other than cups and plates.

FIG. 8 demonstrates that tote 10 has the flexibility to carry items in addition to or instead of cups 34 and plates 30. The vendor would likely be supplied with totes 10 with holes 20 and 22 sized accordingly with his product inventory. Vendor products such as "Snow Cones" 34*c*, ice cream cones 34*b* and soups cups 34*a* are readily transported by X shaped combination 11, if properly sized holes 20 and 22 are provided. By having a selection of totes 10 available, the vendor can freely adapt each construct 11 as needed for each individual product sale.

Figure 9:
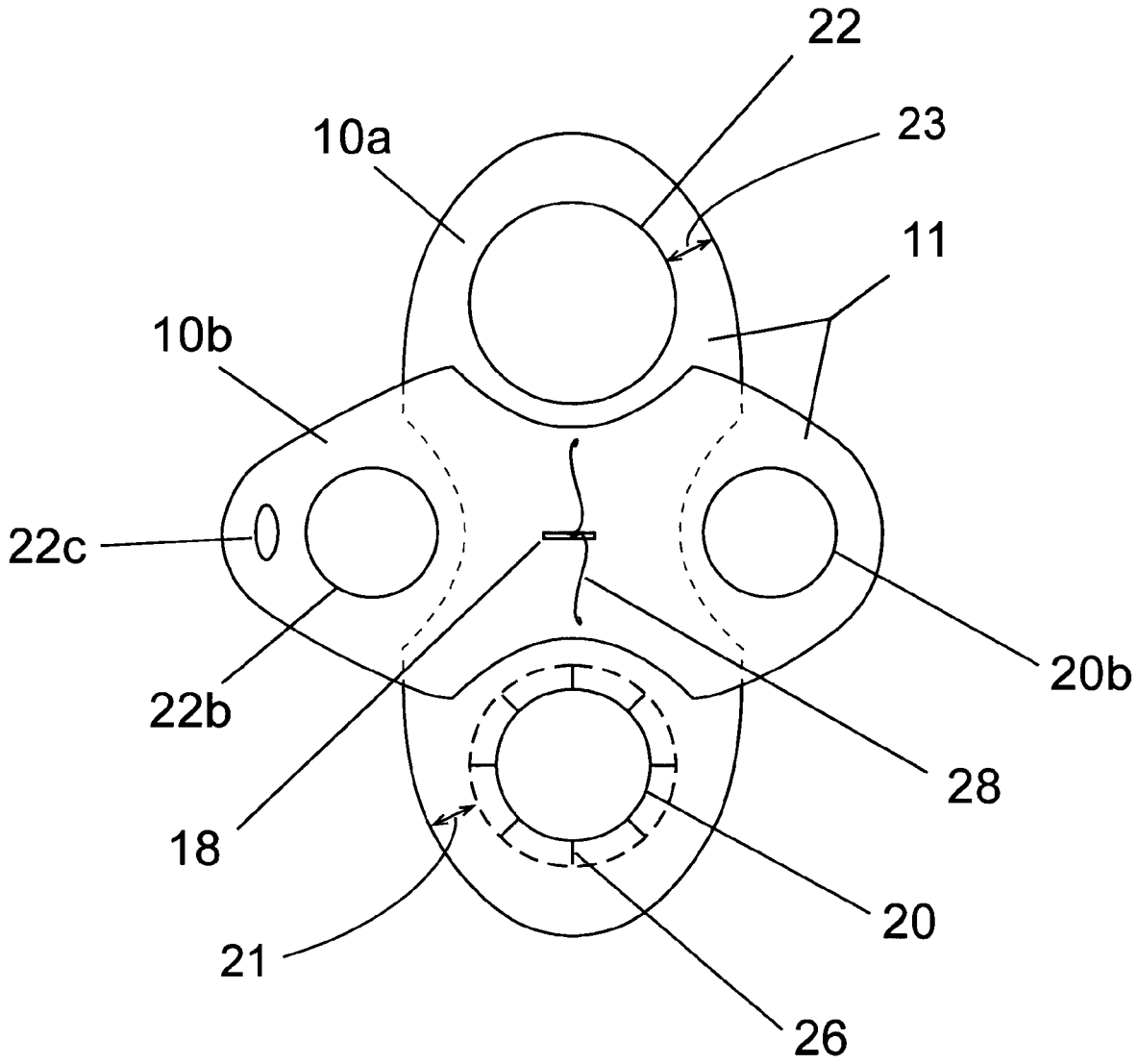
FIG. 9 shows that an optional cutlery holder hole may be manufactured within the semi-rigid construct.

FIG. 9 shows that an optional cutlery holder hole 22*c* may be manufactured within the width 21 or 23 of the semi-rigid construct into either or both of totes 10*a* and 10*b*. Likewise, FIG. 9 shows that construct 10 may have different sized holes as shown in 10*a* and 10*b* to form combination construct 11. Holes 20*b* are smaller than hole 20*a*. Of course, different sized holes may be in a single construct 10.

Figure 10:
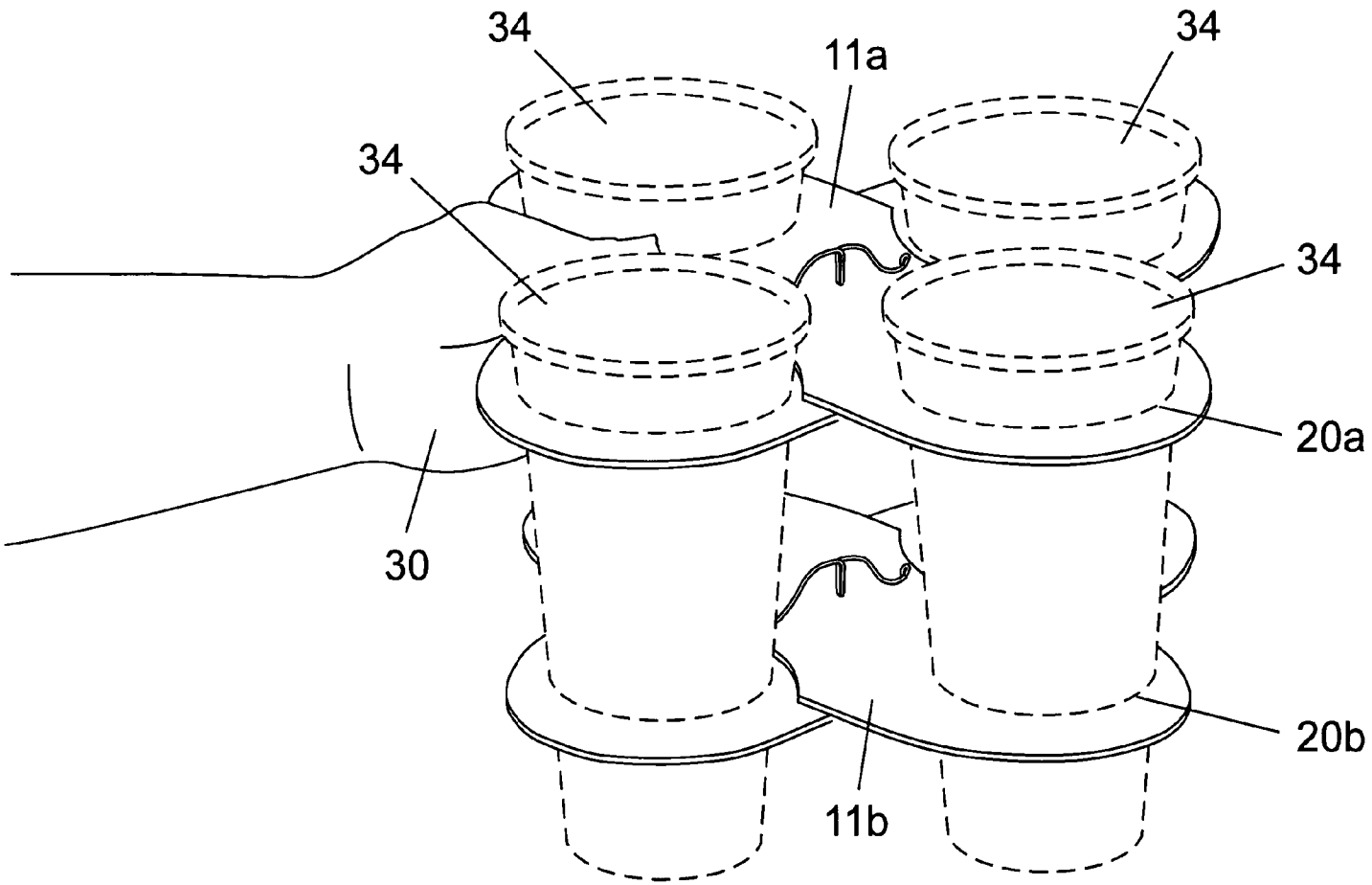
FIG. 10 shows a optional variant combination for a pair of generally X shaped combination constructs.

FIG. 10 is a variant use for a pair of generally X shaped combination constructs 11. Bottom combination constructs 11*b* has smaller holes 20*b*. Bottom constructs 11*b* may be used in combinations with upper generally X shaped combination constructs 11*a* which has larger holes 20*a*. The pair 11*a* and 11*b* used in combination can easily carry up to four cups 34 of beverages (shown in outline}. The bottom construct and top construct lend stability to the transport of the cups shown in outline as 34 when carried by customer hand 30. An elongated carrier clip 38*b* shows an alternative means to carry cups 34.

Figure 11:
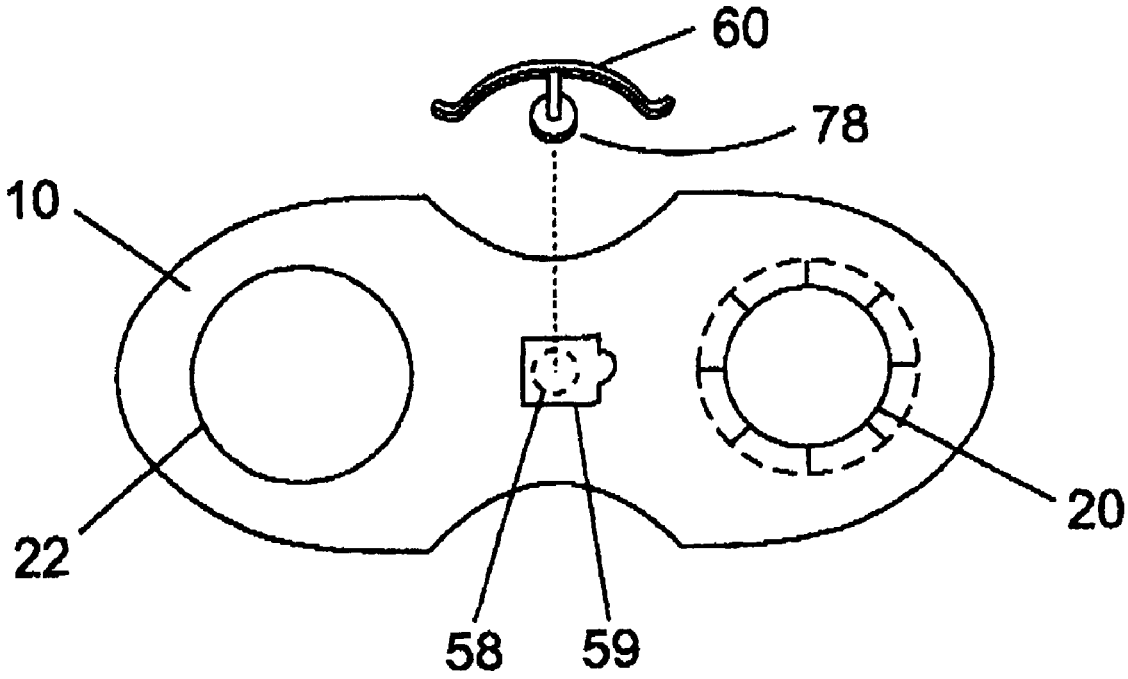
FIG. 11 shows an optional means to attach a clip to a tote.

FIG. 11 shows an optional means to attach a clip to a tote. Cohesive dot 58 is covered by optional release paper 59. Modified clip 60 has a disk part 78. After release paper 59 is removed; disk part 78 may be affixed to glue dot 58 and be a useful part of tote 10.

Figure 12:
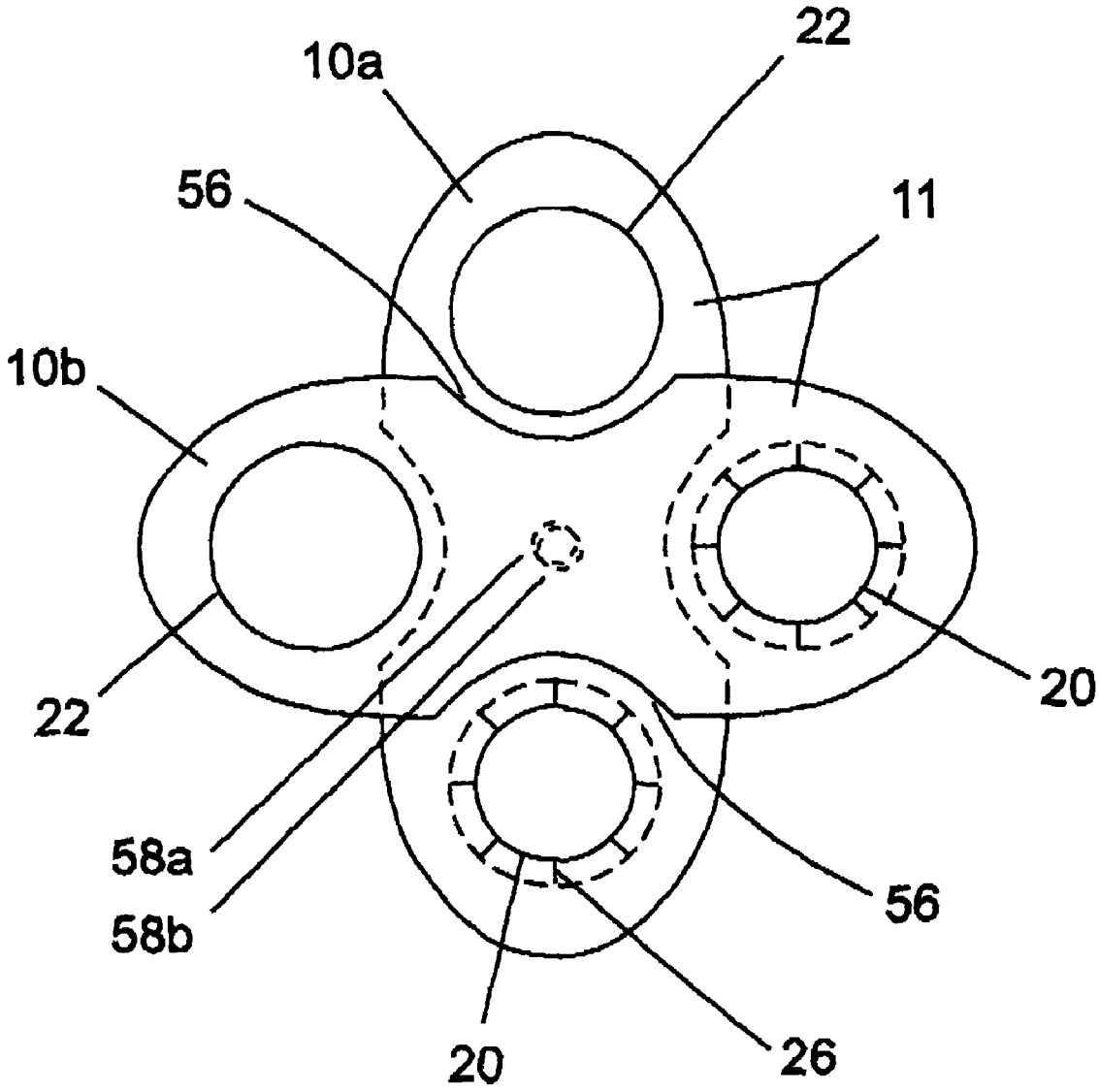
FIG. 12 shows an alternate means of attaching a pair of totes.

FIG. 12 shows an alternate means of attaching a pair of totes 10. Cohesive dot 58 has optional release paper 59 removed. One of the pair of totes 10*b* is flipped over and placed such that dot 58*b* directly contacts dot 58*a* which is attached in a central portion of tote 10*a* so that cohesive dots 58*a* and 58*b* are pressed together to produce an X shaped construct 11.

Figure 13:
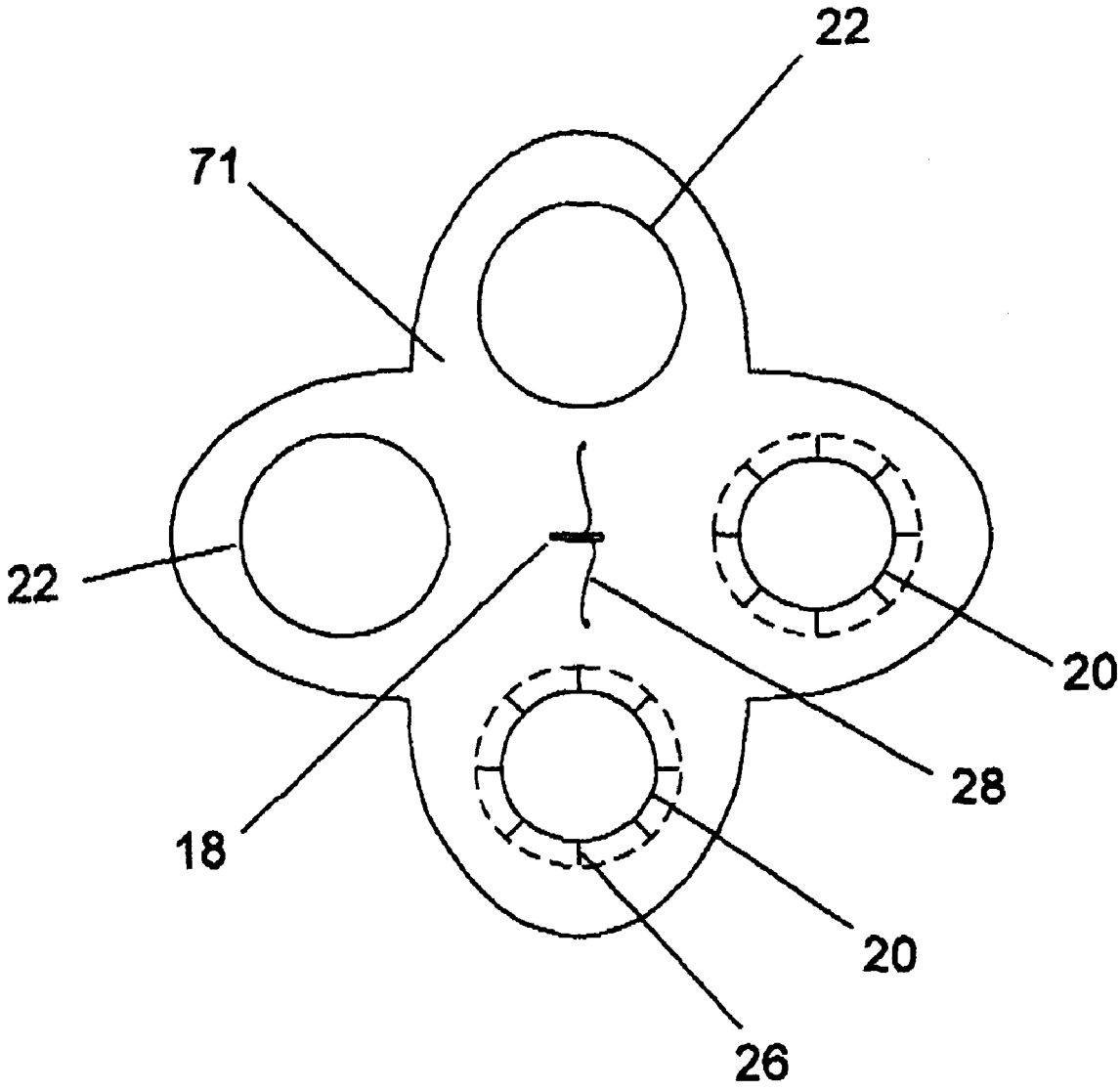
FIG. 13 shows an X-shaped combination tote.

FIG. 13 shows a combination tote 71. This figure shows the X-shaped construct 11 manufactured as generally X shaped combination construct unit with cup opening on each branch of the X-shaped construct. This combination tote 71 can be cut as a unit out of a single piece of one of several semi flexible flat materials easily cut in a cutting press, such as corrugated paper or plastic. In this embodiment an optional clip passage 18 with clip 28 is illustrated. Note, construct 71 is only a single layer of materials whereas the combination units such as in FIG. 2 has two layers that reinforce each other.

Figure 14:
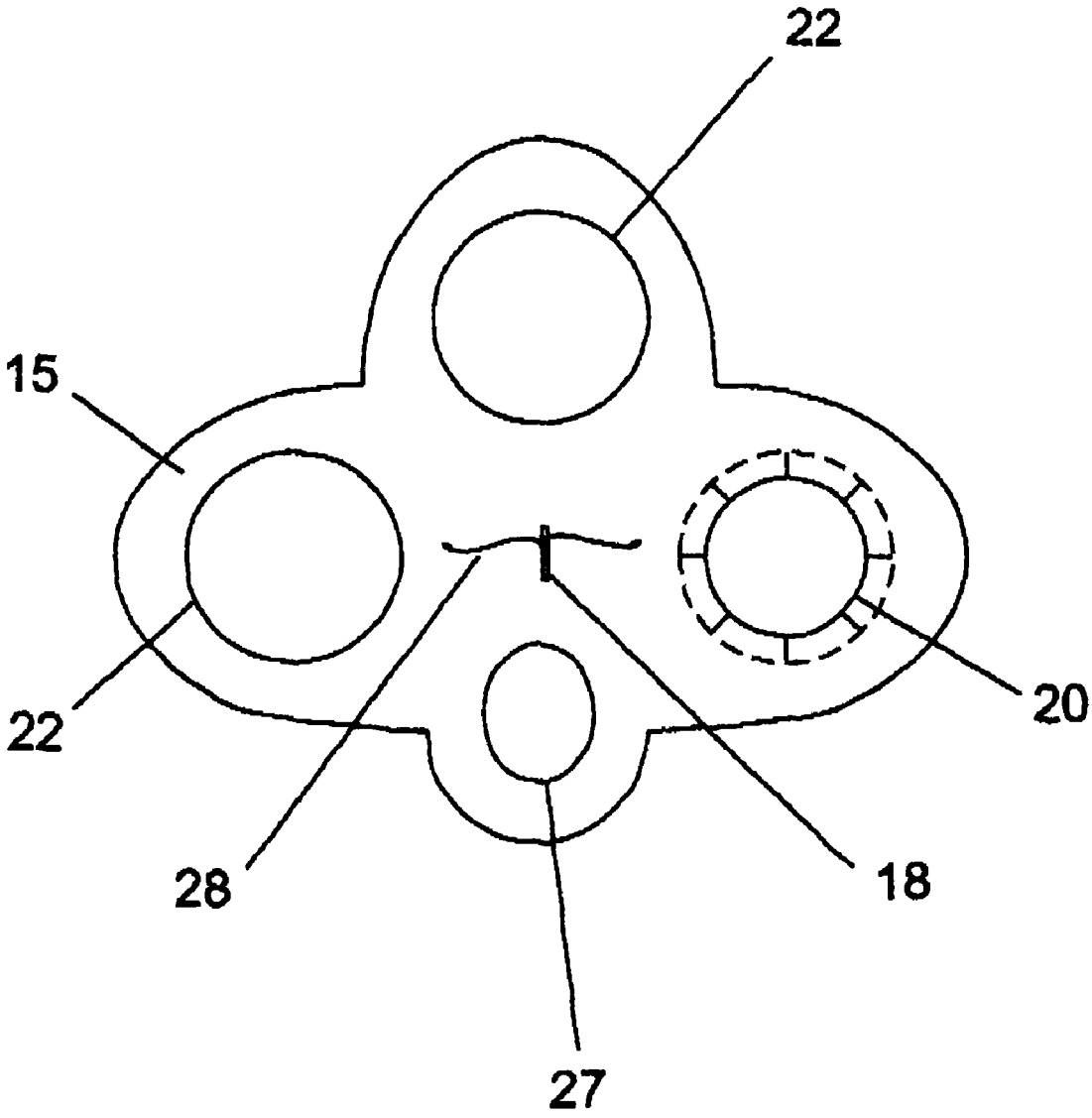
FIG. 14 shows a combination tote.

FIG. 14 shows a combination tote 15. This figure shows that the X-shaped construct 11 can be produced as a single unit. This combination tote 15 has a smaller hole 27 which smaller hole may be used as a thumb hole or a hole for cutlery. In this embodiment an optional clip passage 18 with clip 28 is illustrated.

Figure 15:
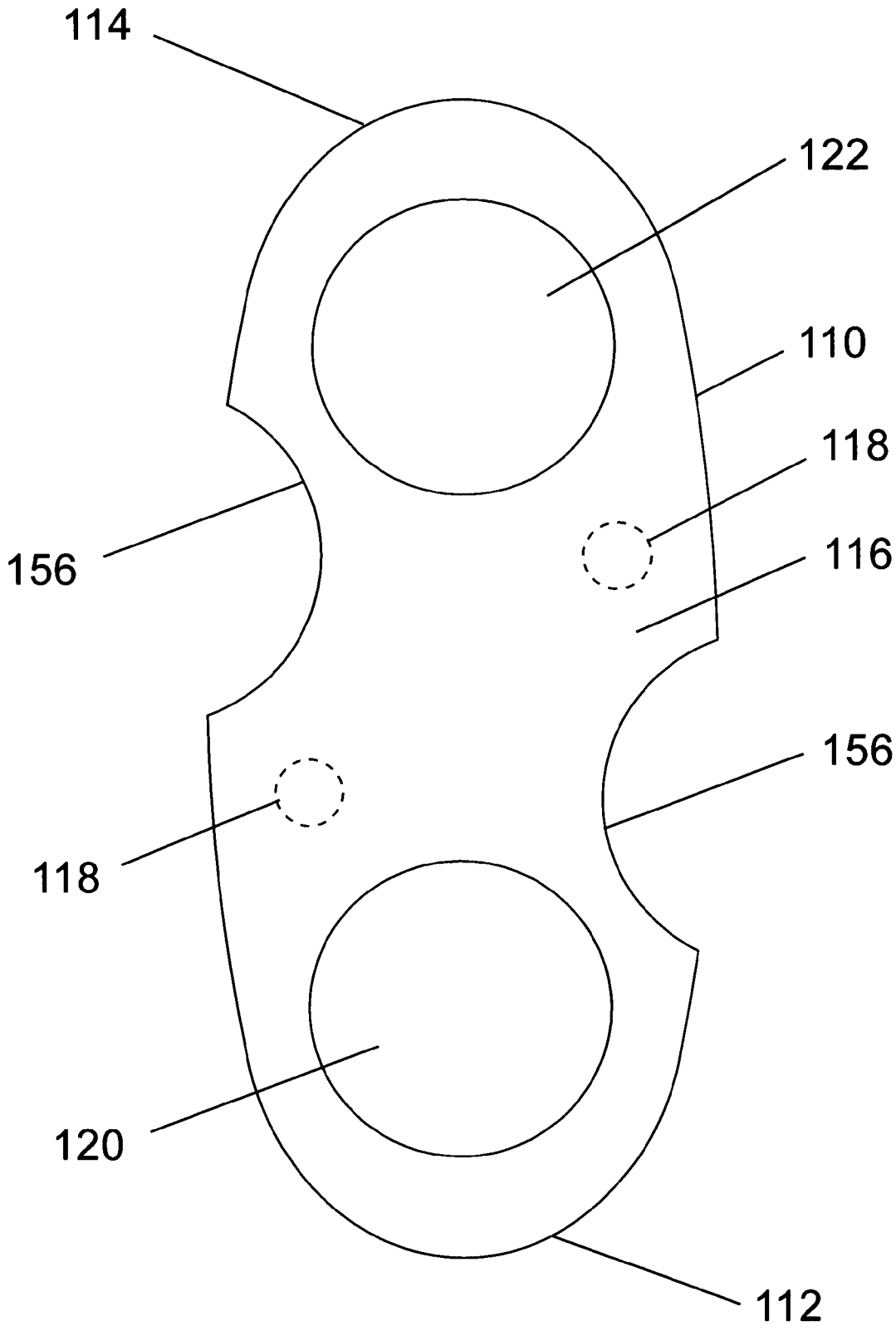
FIG. 15 shows a top view of the semi-rigid beverage cup (drink) tote with asymmetrical quarter circle cuts.

FIG. 15 shows a top view of the semi-rigid beverage cup (drink) tote 110. Drink tote 110 is a flat construct with an enlarged first end 112 and an enlarged second end 114. Enlarged first end 112 is attached to enlarged second end 114 with bridge section 116. One or more glue dots 118 are placed within bridge section 116 as a means to affix a second beverage cup (drink) tote 110 to make a single unit. First hole 120 is in the first enlarged end 112. A second hole 122 is in second enlarged end 114. The first hole 120 and the second hole 122 are sized such to receive typical beverage cups. The quarter circle trimmings 156 in bridge section 116 are asymmetrical to allow a wider bride section 116 to allow a pair of totes 110 to be carried on a bigger forearm.

Figure 16:
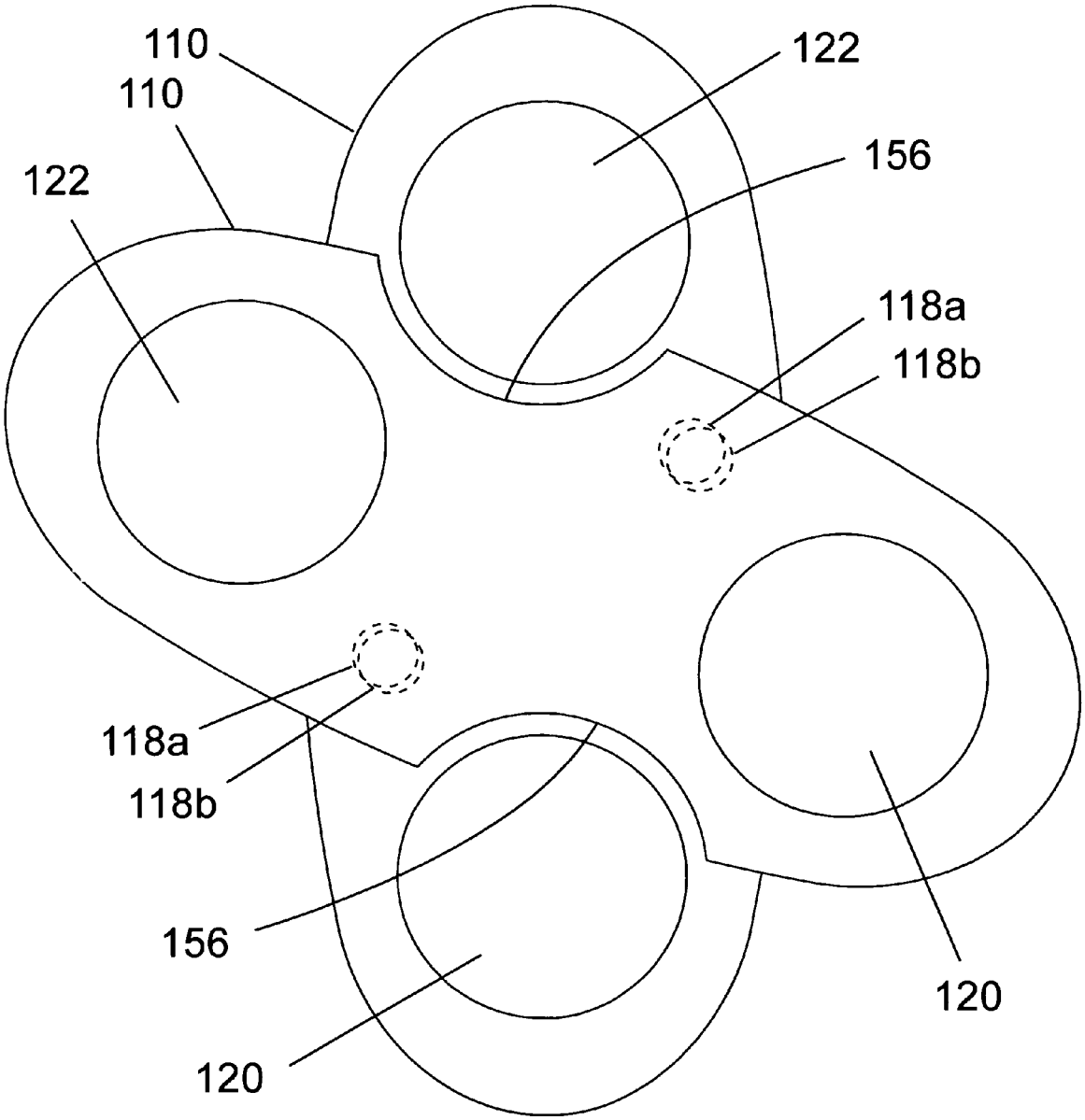
FIG. 16 shows a pair of drink totes with asymmetrical quarter circle cuts affixed with each other.

FIG. 16 shows that a pair of drink totes 110 with asymmetrical quarter circle cuts can be used in combination to carry the drink cups using attachment means (in this case one or more glue dots). First holes 122 and second holes 120 are shown. Asymmetrical quarter circle trimmings 156 allows the transported cups to be placed upon a wider upper arm.

I claim:

1. A beverage cup tote comprising:

a semi-rigid construct with an enlarged first end, wherein said semi-rigid construct has a clip passage in a bridge section;

an enlarged second end;

an outer edge;

said enlarged first end is attached to said enlarged second end with said bridge section;

a first hole is in the first enlarged end;

a second hole is in the second enlarged end;

said bridge section having a length that is between said first hole and said second hole, wherein said length is between about 3.5 inches and 6.5 inches;

said first hole in said first enlarged end and said second hole in said second enlarged end are one of rectangular and round to receive at least one of a food container and a beverage cup;

a first width between said first hole in said first enlarged end and said outer edge, wherein said first width is between about ¾ inch and 1½ inches; and a second width between said second hole in said second enlarged end and said outer edge, wherein said second width is between about ¾ inch and 1½ inches, wherein said semi-rigid construct is connected with another identical semi-rigid construct to form a pair of semi-rigid constructs, wherein said pair of semi-rigid constructs is connected by a pin clip, wherein said pin clip is passed through said clip passage of said semi-rigid construct and a clip passage of said another semi-rigid construct to produce a generally X-shaped combination construct, and wherein said pin clip has two curved wings one of which holds one workpiece plate.

2. A beverage cup tote as in claim 1) wherein said bridge section has a thumb hole.

3. A beverage cup tote as in claim 1) wherein said bridge section has quarter circle trimmings.

4. A beverage cup tote as in claim 3) wherein said quarter circle trimmings are placed asymmetrically.

5. A beverage cup tote as in claim 1) wherein said pair of semi-rigid constructs is connected by one or more adhesive dots that are revealed with release paper.

6. A beverage cup tote as in claim 1) wherein aid pair of semi-rigid constructs is connected by one or more cohesives that do not require release paper.

7. A beverage cup tote as in claim 3) wherein said beverage cup tote is manufactured as a generally X-shaped combination construct unit with cup openings on each branch of said X-shaped construct.

8. A beverage cup tote as in claim 1) wherein said pair of semi-rigid constructs is manufactured and affixed as a combination construct to produce a strengthened unit.

* * * * *